US007204911B2

(12) United States Patent
Liu

(10) Patent No.: US 7,204,911 B2
(45) Date of Patent: Apr. 17, 2007

(54) PROCESS AND APPARATUS FOR FORMING DISCRETE MICROCAVITIES IN A FILAMENT WIRE USING A POLYMER ETCHING MASK

(75) Inventor: Xinbing Liu, Acton, MA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 307 days.

(21) Appl. No.: 10/804,431

(22) Filed: Mar. 19, 2004

(65) Prior Publication Data

US 2005/0205011 A1 Sep. 22, 2005

(51) Int. Cl.
*C23C 1/00* (2006.01)
*B05C 3/00* (2006.01)

(52) U.S. Cl. ..... 156/345.19; 156/345.2; 118/63; 118/66; 118/67; 34/61; 34/625; 34/629; 34/636

(58) Field of Classification Search ..... 156/345.2, 156/345.22; 118/63–68; 216/41–51, 56, 216/90–91; 427/348; 34/61, 90, 623, 625, 34/629, 630, 636
See application file for complete search history.

(56) References Cited

U.S. PATENT DOCUMENTS 2,530,436 A * 11/1950 Maleyre ..... 216/90
4,291,444 A 9/1981 McCarty et al.
4,440,729 A 4/1984 Jonsson
4,869,778 A * 9/1989 Cote ..... 216/103
5,389,853 A 2/1995 Bigio et al.
5,955,839 A 9/1999 Jaffe et al.
6,433,303 B1 8/2002 Liu et al.
6,647,613 B2 11/2003 Beck et al.

OTHER PUBLICATIONS

H. Craighead et al., Selectively Emissive Refractory Metal Surfaces, 38 Applied Physics Letters 74, 1981.
J. Waymouth, Where Will the Next Generation of Lamps Come From?, Fifth International Symposium on the Science and Technology of all Light Sources, Sep. 10-14, 1989, pp. 22-25 and Fig. 20, York, England.
M. Srinivasarao et al, Three-Dimensionally Ordered Array of Air Bubbles in a Polymer Film, 292 Science, 79, Apr. 6, 2001.

* cited by examiner

*Primary Examiner*—Karla Moore
(74) *Attorney, Agent, or Firm*—RatnerPrestia

(57) ABSTRACT

A microcavity-forming system for making microcavities in a wire (especially a tungsten filament wire). The system has a coating station receiving the wire and applying a polymer coating to the wire. A mask-forming station receives the polymer-coated wire and blows moist air over it to form air bubbles which result in holes in the polymer coating, thereby creating a mask. An etching station receives the wire, as coated with the polymer mask, from the mask-forming station and etches the wire through the holes in the polymer mask to form microcavities in the wire. A stripping station receives the wire from the etching station and removes the polymer mask from the wire, leaving the wire with microcavities. Processes of forming microcavities in a wire and, more generally, of making an etching mask having arrays of holes and conforming to substantially any surface, including an arbitrary curved surface, are provided.

10 Claims, 3 Drawing Sheets

PROCESS AND APPARATUS FOR FORMING DISCRETE MICROCAVITIES IN A FILAMENT WIRE USING A POLYMER ETCHING MASK

FIELD OF THE INVENTION

The present invention relates generally to conforming masks useful in etching arrays of holes. More particularly, the invention relates to an apparatus and process, suitable for mass manufacturing environments, for forming microcavities in a filament wire to improve radiative efficiency.

BACKGROUND OF THE INVENTION

The cost of producing and purchasing electricity has escalated to all-time highs worldwide. Such escalation is especially true in under-developed countries where electricity supply is limited, as well as in those countries with large populations where the demand for electricity is high. Driven by this demand is an ever-increasing desire to produce lighting sources that are energy efficient and minimize the cost of electric usage.

One of the more efficient lighting sources is the incandescent light bulb. Over the past two centuries, scientists and inventors have strived to develop a cost-effective, practical, long-life incandescent light bulb. Developing a long-life, high-temperature filament is a key element in designing a practical incandescent light bulb.

Tungsten filaments have been found to offer many favorable properties for lighting applications, such as a high melting point (3,410° C. or 6,170° F.), a low evaporation rate at high temperatures (10-4 torr at 2,757° C. or 4,995° F.), and a tensile strength greater than steel. These properties allow the filament to be heated to higher temperatures to provide brighter light with favorable longevity, making tungsten a preferred material for filaments in commercially available incandescent light bulbs.

The filament of an incandescent lamp emits visible and non-visible radiation when an electric current of sufficient magnitude is passed through it. The filament emits, however, a relatively small portion of its energy, typically 6 to 10 percent, in the form of visible light. Most of the remainder of the emitted energy is in the infrared region of the light spectrum and is lost in the form of heat. As a consequence, radiative efficiency of a typical tungsten filament, measured by the ratio of power emitted at visible wavelengths to the total radiated power over all wavelengths, is relatively low: on the order of 6 percent or less.

Conventional techniques for increasing the amount of visible light emitted by an incandescent filament rely on increasing the amount of energy available from the filament by increasing the applied electrical current. Increasing the current, however, wastes even larger amounts of energy. What is needed is a tungsten filament that emits increased visible light without increasing energy consumption.

Another concern is the life span of a filament. A tungsten filament is very durable. Nevertheless, after a prolonged period of time, large electrical currents cause excessive electron wind, which occurs when electrons bombard and move atoms within the filament. Over time, this effect causes the filament to wear thin and eventually break.

It has been observed that the radiative efficiency of filament material such as tungsten may be increased by texturing the filament surface with submicron-sized features. A method of forming submicron features on the surface of a tungsten sample using a non-selective reactive ion etching technique is disclosed by H. Craighead, R. Howard, and D. Tennant in "Selectively Emissive Refractory Metal Surfaces," 38 Applied Physics Letters 74 (1981). Craighead et al. disclose that improved radiative efficiency results from an increase in the emissivity of visible light from the tungsten. Emissivity is the ratio of radiant flux, at a given wavelength, from the surface of a substance (such as tungsten) to radiant flux emitted under the same conditions by a black body. The black body is assumed to absorb radiation incident upon it.

Craighead et al. disclose that the emissivity of visible light from a textured tungsten surface is twice that of a non-textured surface. The authors suggest that the increase is a result of more effective coupling of electromagnetic radiation from the textured tungsten surface into free space. The textured surface of the tungsten sample disclosed by Craighead et al. has depressions in the surface separated by columnar structures projecting above the filament surface by approximately 0.3 microns.

Another method for enhancing incandescent lamp efficiency by modifying the surface of a tungsten lamp filament appears in a paper entitled "Where Will the Next Generation of Lamps Come From?", by J. Waymouth, pages 22–25 and FIG. 20, presented at the Fifth International Symposium on the Science and Technology of All Light Sources, York, England, on Sep. 10–14, 1989. Waymouth hypothesizes that filament surface perforations measuring 0.35 microns across and 7 microns deep, and separated by walls 0.15 microns thick, may act as waveguides to couple radiation in the visible wavelengths between the tungsten and free space, but inhibit emission of non-visible wavelengths. Waymouth discloses that the perforations on the filament may be formed by semiconductor lithographic techniques, but such perforation dimensions are beyond current state-of-the-art capabilities.

Another method for reducing infrared emissions of an incandescent light source is described in U.S. Pat. No. 5,955,839 issued to Jaffe et al. As described, the presence of microcavities in a filament provides greater control of directivity of emissions and increases emission efficiency in a given bandwidth. Such a light source may have microcavities, for example, between 1 micron and 10 microns in diameter. Although features having these dimensions may be formed in some materials using microelectronic processing techniques, it is difficult to form them in the metals, such as tungsten, commonly used for incandescent filaments.

Yet another method for reducing infrared emissions of an incandescent light source is disclosed in U.S. Pat. No. 6,433,303 issued to Liu et al. and entitled "Method and Apparatus Using Laser Pulses to Make an Array of Microcavity Holes." The disclosed method uses a laser beam to form individual microcavities in a metal film. An optical mask divides the laser beam into multiple beams and a lens system focuses the multiple beams onto the metal film and forms the microcavities. In their own research, the present inventors have used femtosecond laser pulses to drill holes on flat tungsten surfaces. Such laser drilling suffices to provide research samples, but laser drilling will not be suitable for mass production given the high cost of the drilling process. Moreover, drilling of curved, rather than flat, surfaces presents additional problems.

Still another method is disclosed in U.S. Pat. No. 5,389,853 issued to Bigio et al. Bigio et al. describe a filament having improved emission of visible light. The emissivity of the tungsten filament is improved by depositing a layer of submicron-to-micron crystallites on its surface. The crystallites are formed from tungsten or a tungsten alloy of up to 1 percent thorium and up to 10 percent of at least one of rhenium, tantalum, or niobium.

Although these conventional methods form microcavities and improve light emissivity, they are complex and costly. None of these methods is suitable for mass manufacturing environments where cost and efficiency are important factors. Consequently, a need still exists for a method of making microcavities in a filament that is suitable for mass manufacturing environments.

SUMMARY OF THE INVENTION

To meet this and other needs, and in view of its purposes, the present invention provides a microcavity-forming system for making microcavities in a wire (especially a tungsten filament wire). The system has a coating station receiving the wire from a source of the wire and applying a polymer coating to the wire. A mask-forming station receives the polymer-coated wire from the coating station and blows moist air over the polymer-coated wire to form air bubbles which result in holes in the polymer coating, thereby creating a mask. An etching station receives the wire, as coated with the polymer mask, from the mask-forming station and etches the wire through the holes in the polymer mask to form microcavities in the wire. A stripping station receives the wire from the etching station and removes the polymer mask from the wire, leaving the wire with microcavities.

Further provided is a process of forming microcavities in a wire. The process includes the step of receiving the wire from a source of the wire and applying a polymer coating to the wire. Then moist air is blown over the polymer-coated wire to form air bubbles which result in holes in the polymer coating, thereby creating a mask. The wire is etched through the holes in the polymer mask to form microcavities in the wire. Finally, the polymer mask is removed from the wire, leaving the wire with microcavities.

Still further provided is a process of making an etching mask having arrays of holes. The mask conforms to substantially any surface, including an arbitrary curved surface. The process includes the steps of (a) providing the surface to be etched; (b) applying a polymer coating to the surface; and (c) blowing moist air over the polymer-coated surface to form air bubbles which result in holes in the polymer coating, thereby creating a mask.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

Figure 1:
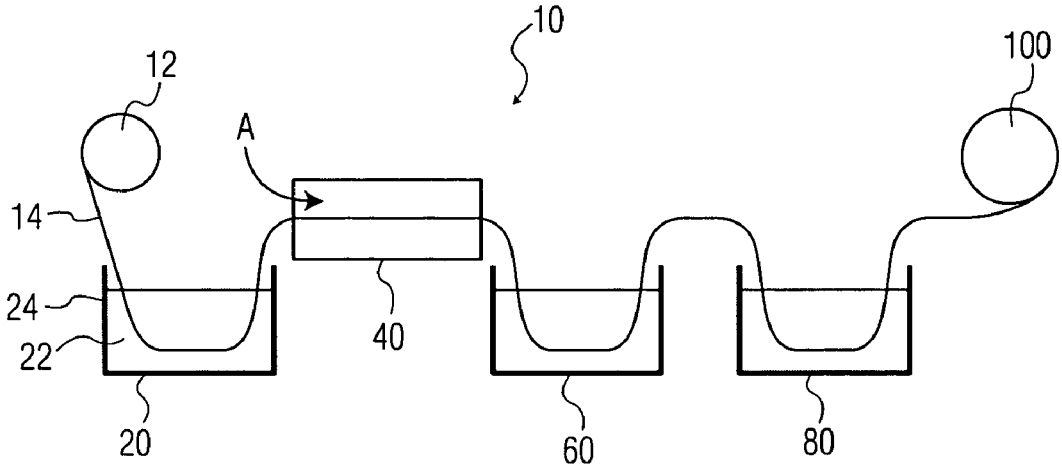
FIG. 1 is a schematic diagram of a system for making microcavities in a tungsten filament in accordance with the present invention.

Preferred features of embodiments of the present invention are now described with reference to the figures. It will be appreciated that the invention is not limited to the embodiments selected for illustration. Rather, it is contemplated that any of the configurations and materials described below may be modified within the scope of this invention.

DETAILED DESCRIPTION OF THE INVENTION

The present invention results from research directed toward an improved type of tungsten (W) incandescent lighting element, in which regular arrays of sub-micrometer-sized holes are made in the tungsten wire (called a microcavity array). The purpose of the microcavity array is to inhibit or reduce light emission in the infrared region, thus reducing heat generation and increasing lighting efficiency. The emission cut-off wavelength is proportional to the diameter of the holes.

An obstacle faced by this research is to find a method for mass production of the microcavity arrays in the tungsten wire. The researchers identified lithography as one possible method, in which a mask having holes is imaged onto a resist. The resist is developed, and the holes are etched into the tungsten through the patterned resist. Conventional lithography using a mask works only with planer surfaces, however, and cannot be used to pattern the cylindrical surface of the tungsten wire. In addition, conventional lithography may be too expensive for the mass production of microcavity tungsten wire. A more detailed description of conventional lithography follows.

A mask is a thin sheet or layer of metal, polymer, or other material containing an open pattern. The mask is used to shield selected portions of a substrate, such as a semiconductor, or other surface during a deposition or etching process. One particular type of mask, called a resist, is used in the process of lithography.

One particular type of lithography, called photolithography, is an optical process for transferring patterns onto a substrate. It is essentially the same process that is used in lithographic printing. Patterns are first transferred to an imagable photoresist layer. The photoresist is a film that is deposited onto the substrate, exposed with a desired pattern, and developed into a selectively placed layer for subsequent processing.

Using conventional approaches, it is often difficult to apply a resist layer that has a uniform thickness. Forming a uniform resist layer is an especially important consideration because the resist is used to pattern the specific features of the device to be manufactured (e.g., a semiconductor chip, a servo write head, or the like). Non-uniformity of the resist thickness directly and adversely affects the quality of the patterns, especially those having minute dimensions and tight geometric tolerances. More specifically, it is especially difficult to apply a resist layer that has a uniform thickness to a surface that is curved. Typically, one must compensate for the curvature of the surface in the lithographic process. U.S. Pat. No. 6,647,613 issued to Beck et al. discusses such compensation in the context of applying a resist layer to a curved surface during manufacture of a magnetic write head.

There remains a need, therefore, for an improved mask that can conform, with substantially uniform thickness, to a curved substrate surface. A related need is to improve manufacturing processes by using such a mask during a deposition or etching process step. Such an improved mask would find specific application in the process of manufacturing the filament of incandescent light bulbs, an application to which attention is now turned.

Referring to FIG. 1, the exemplary tungsten filament manufacturing system 10 of the present invention includes a source 12 of tungsten wire 14, a coating station 20, a mask-forming station 40, an etching station 60, a stripping station 80, and a coiling device 100. In operation, tungsten wire 14 travels from source 12 to coating station 20. Wire 14 is coated with a material such as polymer 22 at coating station 20. Next, wire 14 travels to mask-forming station 40, at which moist air "A" is blown (in the direction shown) over the coated wire 14 to form air bubbles in polymer 22. Following processing at mask-forming station 40, the polymer coating 16 on wire 14 has holes which enable polymer coating 16 to function as a mask. Wire 14 then travels to etching station 60, where tungsten wire 14 is etched, through the holes of polymer coating 16, to form a microcavity array in wire 14. At stripping station 80, polymer coating 16 is removed from wire 14. Finally, wire 14, having a microcavity array, is processed for packing and shipping by using, for example, coiling device 100. Each of the stages or stations of system 10 is discussed more fully below.

1. Coating Station 20

Figure 2:
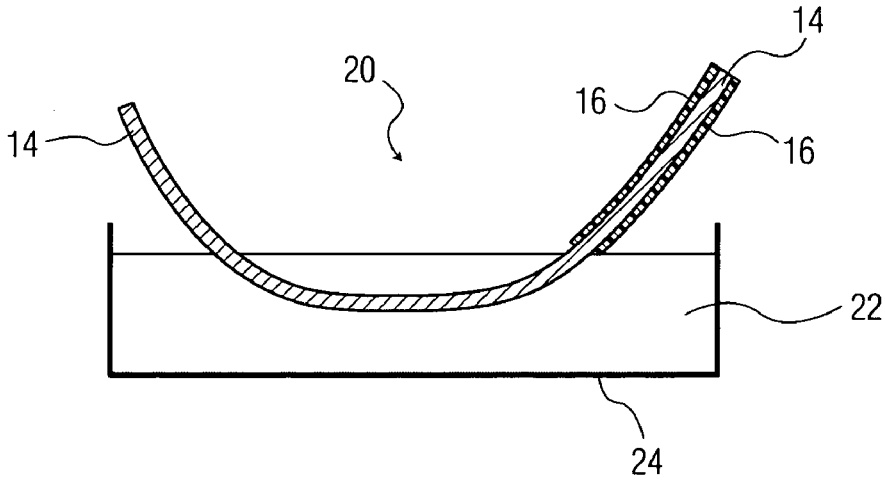
FIG. 2 is a schematic diagram highlighting the coating station of the system of FIG. 1, applying a dip coat in accordance with an embodiment of the present invention.

FIG. 2 is a schematic diagram highlighting coating station 20 of system 10 of FIG. 1. As shown in FIG. 2, wire 14 is coated with a material such as polymer 22 at coating station 20. In the example shown, polymer 22 is provided as a solution contained within a tank 24. A suitable solution comprises a coil-like polymer such as polystyrene (preferably attactic with a weight-average molecular weight of 50,000) in a fast-evaporating solvent such as benzene ($C_6H_6$), toluene ($CH_3C_6H_5$), or carbon disulfide ($CS_2$). The solution preferably contains a dilute (0.1 to 10 percent by weight and, more preferably, 0.1 to 5 percent by weight) polymer.

Researchers have so far found that three different types of polymer and several solvents are acceptable. In some cases, the surface of tungsten wire 14 may be hydrophobic (i.e., the surface may be antagonistic to, shed, or tend not to combine with water), rendering use of a particular polymer solution more difficult. This difficulty might be overcome by coating the surface of tungsten wire 14 with a surfactant to enhance the adhesion between the polymer solution and wire 14. Care also must be taken to control the thickness of polymer coating 16. Preferably, the coating conditions are controlled to produce a thickness for polymer coating 16 of about 0.05 to 1 μm when dried.

Although illustrated as a dip coating process, other processes are envisioned for coating station 20. Spray or brush coating are two other example processes suitable for application of polymer coating 16 to tungsten wire 14. These processes are relatively cumbersome, however, and may be insufficiently refined for submicron geometric tolerances. Applying coating 16 by spinning is also possible, but may be difficult because the length-to-width ratio of wire 16 is far greater than unity.

Figure 2A:
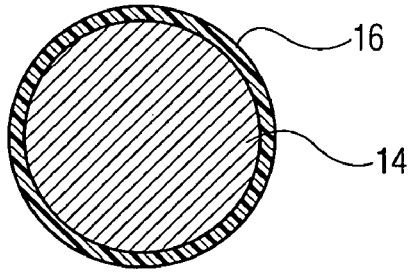
FIG. 2A is a cross-sectional view of the polymer-coated tungsten wire following the coating step illustrated in FIG. 2 in accordance with an embodiment of the present invention.

FIG. 2A is a cross-sectional view of the polymer-coated tungsten wire following the coating step illustrated in FIG. 2 in accordance with an embodiment of the present invention. Wire 14 has a substantially uniform layer of polymer coating 16.

2. Mask-Forming Station 40

Figure 3:
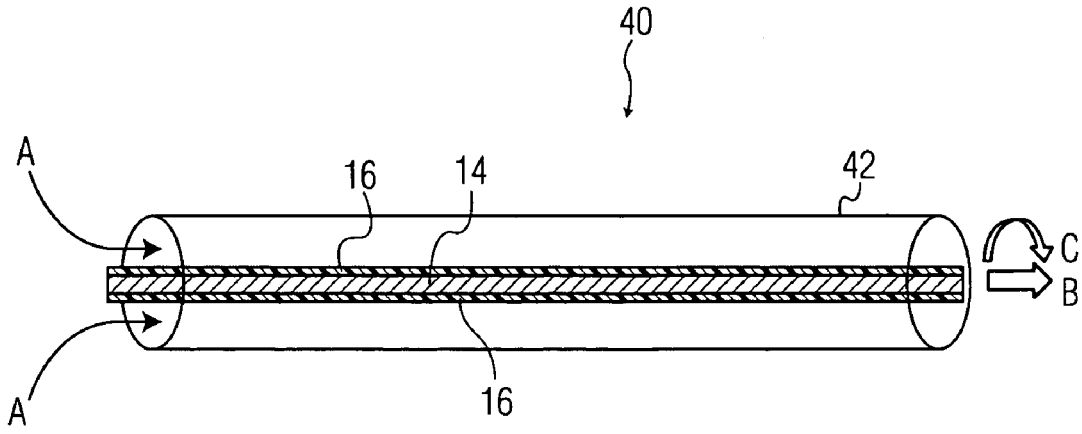
FIG. 3 is a schematic diagram highlighting the mask-forming station of the system of FIG. 1, forming a polymer etching mask on the tungsten wire in accordance with an embodiment of the present invention.

FIG. 3 is a schematic diagram highlighting mask-forming station 40 of system 10 of FIG. 1. At mask-forming station 40, a polymer etching mask is formed on tungsten wire 14 in accordance with an embodiment of the present invention. The process step completed at mask-forming station 40 is based upon the principles discussed by M. Srinivasarao et al. in "Three-Dimensionally Ordered Array of Air Bubbles in a Polymer Film," 292 *Science* 79 (Apr. 6, 2001).

Generally, the authors teach the formation of a three-dimensionally ordered array of air bubbles of monodisperse pore size in a polymer film through a templating mechanism based on thermocapillary convection. Dilute solutions of a simple, coil-like polymer in a volatile solvent are created in the presence of moist air flowing across the surface. Evaporative cooling leads to the formation of single or multi-layers of hexagonally packed water droplets that are preserved in the final, solid polymer film as spherical air bubbles. The dimensions of these bubbles can be controlled simply by changing the velocity of the airflow across the surface.

More specifically, as shown in FIG. 3, mask-forming station 40 includes a chamber 42 creating a controlled atmosphere around wire 14 having coating 16 of polymer-solvent solution. Wire 14 is drawn through chamber 42 in the direction of arrow "B" while wire 14 is also turned in the direction of arrow "C." Moist air A is blown into chamber 42, and over coated wire 14, in the direction of the arrows shown. The temperature, moisture content, and speed of the blown moist air A are carefully controlled to achieve the desired results (discussed below).

Within several seconds after moist air A is directed across wire 14, the solvent (e.g., toluene, benzene, or carbon disulfide) evaporates. The high vapor pressure of the solvent and the velocity of air A across the surface drive solvent evaporation, rapidly cooling the surface. This rapid evaporation cooling of the solvent lowers the temperature of the solution by as much as 25° C. below room temperature, resulting in an evaporating polymer surface of near 0° C.

Moisture from the warmer air A condenses on the relatively cooler surface of the solution, forming through nucleation and growth a layer of uniform-size water droplets or "breath figures" (breath figures form when a cold solid or a liquid surface is brought in contact with moist air) packed tightly together like billiard balls. The water droplets grow as a function of time. The solution surface is colder because of evaporative cooling, whereas the water droplets are warmer because of the latent heat of condensation. This large temperature difference will lead to a thermocapillary convection and stabilize the condensing water droplets on or at the polymer solution surface. Airflow across the solution surface, coupled with convection currents on the solution surface due to evaporation, drive the ordering or packing of the water droplets into hexagonally packed arrays.

Figure 3A:
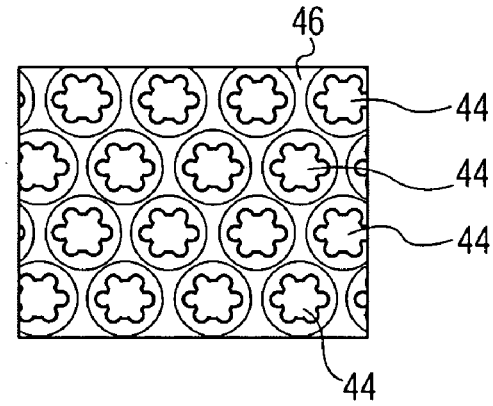
FIG. 3A is an image showing air bubbles in a self-assembled polymer structure.

When the surface is completely covered by water droplets, the temperature difference between the surface and the droplets eventually dissipates and the droplets, because they are more dense than the solvent, sink into the solution. Once the solution surface is free, the whole process of evaporative cooling, water droplet condensation, and subsequent ordering repeats. Thus, because the water is more dense than the solvent, the layer of droplets sinks into the polymer solution, allowing another layer to quickly form on top of it. The solvent must be less dense than water for the droplets to sink into the solution. The process repeats itself for one to two minutes until all of the solvent is evaporated, producing a three-dimensional pattern of closely packed water droplets preserved in the polymer film. The water then evaporates layer by layer, leaving an interconnected network of air bubbles. FIG. 3A is an image showing air bubbles 44 in a self-assembled polymer structure 46. A 30–40 micron thick polymer structure 46 may contain as many as 15 layers of air bubbles 44.

When a solvent less dense than water is used, such as benzene or toluene, the hexagonal array propagates through the polymer film. An ordered, three-dimensional structure results in which each layer of the ordered structure is distinct from the subsequent layer. In contrast, in samples generated from a solvent more dense than water, such as carbon disulfide, only a single layer of bubbles is formed and a three-dimensional array is not produced. A single layer of bubbles is preferred for the specific application of forming microcavities in a filament wire.

When all of the solvent has evaporated, the polymer film must return to room temperature. At room temperature, the water droplets evaporate and leave behind an ordered array of holes of substantially uniform size on the solid polymer surface. The size of these holes can be easily tailored and dynamically controlled within the range of 0.2 to 20 microns (and, more preferably, between 0.2 and 1 micron) simply by changing the velocity of airflow across the solution surface. Rather than wait for the water droplets to evaporate, it may be desirable to remove the water droplets using, for example, a surfactant. A suitable surfactant would attract the water but not the solvent.

Although the process appears simple, its success depends on an unusual phenomenon: the willingness of the tiny water droplets to remain separate and not coalesce to form larger drops. The reason for this phenomenon is not fully understood, although observations made more than one hundred years ago by British physicist Lord Rayleigh—and work by contemporary scientists—suggest an explanation. In the initial stages of the growth process of breath figures, the droplets grow as isolated objects with no interaction between droplets. The temperature difference between warm most air A and the cold solution surface causes the droplets to spin, pulling rapidly moving air with them. The air keeps these tiny droplets apart, preventing them from coalescing into larger drops. The large temperature reduction caused by the evaporating solvent may turn the droplets into tiny balls of ice. The researchers believe the technique may also work with vapors of material other than water.

The diameter of the water droplets is related to the velocity of air A flowing over the polymer solution. As the air flow rate increases from 30 meters per minute to 300 meters per minute, the droplet size decreases from 6 microns to 0.2 microns. The higher velocity could produce porous structures as small as 50 nanometers. Another important condition is humidity, which must be at least 30 percent to produce the tiny water droplets.

Figure 3B:
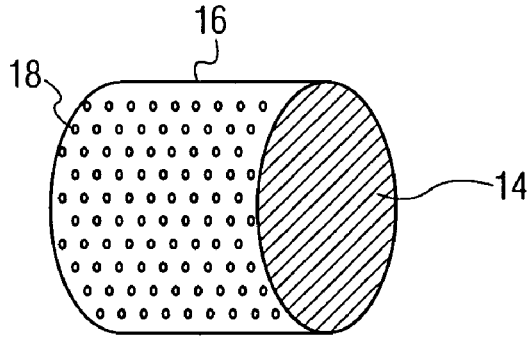
FIG. 3B is a perspective view of the wire following the mask-forming step illustrated in FIG. 3 in accordance with an embodiment of the present invention.

FIG. 3B is a perspective view of wire 14 following the mask-forming step illustrated in FIG. 3 in accordance with an embodiment of the present invention. Wire 14 has a substantially uniform layer of polymer coating 16, with polymer coating 16 having regular, close-packed holes 18 of diameter 0.2 to 1 micron. Polymer coating 16 provides the mask necessary to etch wire 14. Of course, polymer coating 16 might also function as a mask for a variety of applications other than that of forming microcavities in wire 14.

3. Etching Station 60

Figure 4:
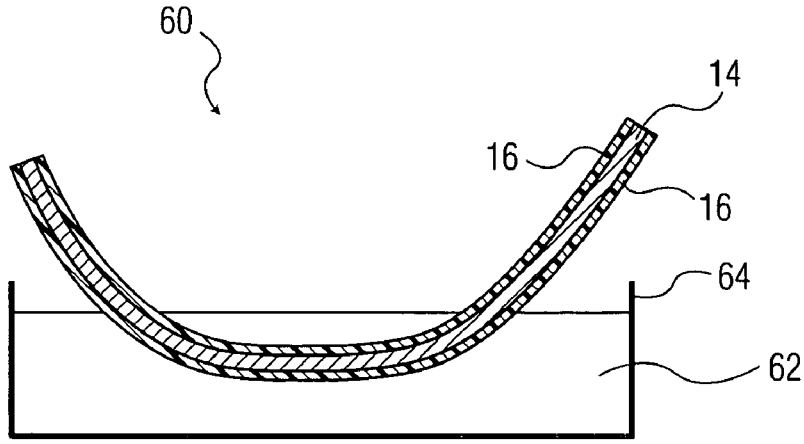
FIG. 4 is a schematic diagram highlighting the etching station of the system of FIG. 1, which etches the tungsten wire through the polymer mask in accordance with an embodiment of the present invention.

FIG. 4 is a schematic diagram highlighting etching station 60 of system 10 of FIG. 1. At etching station 60, tungsten wire 14 is etched through the mask or polymer coating 16 in accordance with an embodiment of the present invention. In the example shown, the process of etching is done via a wet etching in an etching bath 62 such as hydrogen peroxide (preferably 30% hydrogen peroxide). Etching bath 62 is retained within a container 64. Etching bath 62 passes through holes 18 of polymer coating 16 to create the microcavities 90 (see FIG. 6) in wire 14. Various other possible etching processes are suitable for creating microcavities 90 in wire 14 through polymer coating 16. Such processes are within the knowledge of a skilled artisan and include, for example, gas phase chemical etching in a suitable environment such as hydrogen peroxide vapor.

It is feasible that, in some cases, especially when only a single layer of bubbles is formed, the bubbles may not extend completely through the polymer film as desired during formation of the mask or polymer coating 16. In such cases, etching station 60 may include a preliminary or initial etch of polymer coating 16 to assure that the holes created by the bubbles extend complete through polymer coating 16. The initial etch of the mask is stopped before implementing the etch of wire 14.

In addition, remaining air bubbles in the holes of polymer coating 16 may prevent etchant from penetrating those holes. Therefore, an additional step of evacuating the air bubbles from the holes may be desirable. Such a step would be performed before the etching step begins.

4. Stripping Station 80

Figure 5:
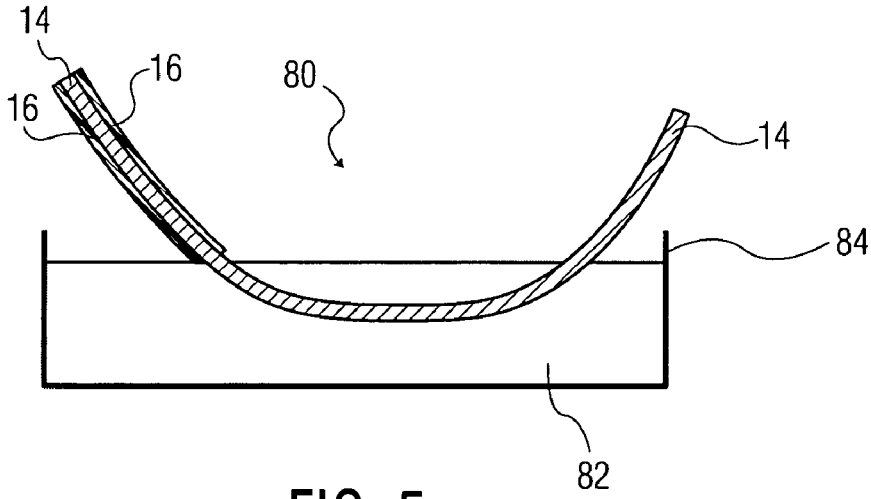
FIG. 5 is a schematic diagram highlighting the stripping station of the system of FIG. 1, which strips the polymer mask from the tungsten wire in accordance with an embodiment of the present invention.

FIG. 5 is a schematic diagram highlighting stripping station 80 of system 10 of FIG. 1. At stripping station 80, polymer coating 16, having completed is function as a mask during the etching process, is stripped from tungsten wire 14 in accordance with an embodiment of the present invention. In the example shown, the process of stripping is done using a solvent bath 82 that dissolves polymer coating 16. Solvent bath 82 is contained within an enclosure 84. Various other possible stripping processes are suitable for removing polymer coating 16 from wire 14. Such processes are within the knowledge of a skilled artisan and include, for example, burning off polymer coating 16.

5. The Final Product

Figure 6:
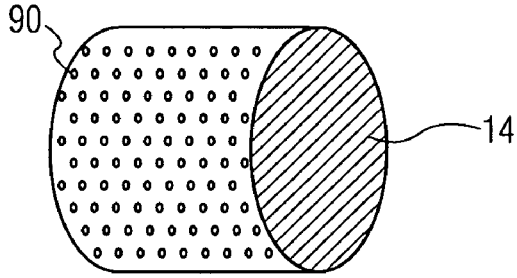
FIG. 6 is a perspective view of the wire following the stripping step illustrated in FIG. 5 in accordance with an embodiment of the present invention.

Once the mask or polymer coating 16 has been removed from wire 16, the final product has been achieved. FIG. 6 is a perspective view of wire 14 following the stripping step illustrated in FIG. 5 in accordance with an embodiment of the present invention. As depicted in FIG. 6, tungsten wire 14 has a plurality of uniformly dimensioned and precisely distributed microcavities 90.

The present invention provides an improvement over conventional processes of forming microcavities 90 in filament wire 14: the invention is suitable for mass production manufacturing environments where cost and efficiency are important factors. The present invention does not require complicated and costly devices; instead, the invention uses simple mechanical components to form microcavities 90.

The present invention may also be implemented with minimum changes to a conventional filament manufacturing production line. Stated alternatively, the process of the present invention can be adopted by the existing tungsten wire manufacturing process in the factory.

The invention incorporates the unique property of self-assembling hole formation in certain polymers. The process of the present invention is also a generic process of making a conforming mask (on arbitrary curved surface) having arrays of holes. The process can form a mask of arrays of sub-micrometer-to-micrometer sized holes on any surface, and is not limited to planar surfaces only. Thus, the process is expected to be inexpensive compared to other processes such as laser drilling or conventional photolithography.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention.

What is claimed:

1. A microcavity-forming system for making microcavities in a wire comprising:

a coating station receiving the wire from a source of the wire and applying a polymer coating to the wire, the polymer coating having an outer surface encircling the wire;

a mask-forming station receiving the polymer-coated wire from the coating station and blowing moist air over the polymer-coated wire to form air bubbles which result in holes substantially evenly distributed over the outer surface of the polymer coating, thereby creating a mask, the mask forming station including:

a chamber to create a controlled atmosphere around the polymer-coated wire;

a blower to blow moist air over the polymer coated wire; and rotating means to rotate the polymer-coated wire as it is drawn through the chamber;

an etching station receiving the wire, as coated with the polymer mask, from the mask-forming station and etching the wire through the holes in the polymer mask to form microcavities in the wire; and a stripping station receiving the wire from the etching station and removing the polymer mask from the wire, leaving the wire with microcavities.

2. The system of claim 1 wherein the wire is tungsten.

3. The system of claim 2 wherein the coating station comprises a tank housing a solution of the polymer in a fast-evaporating solvent.

4. The system of claim 3 wherein the solution comprises 0.1 to 10 percent by weight of polymer.

5. The system of claim 3 wherein the polymer is polystyrene and the solvent is selected from the group consisting of benzene, toluene, and carbon disulfide.

6. The system of claim 5 wherein the solvent is carbon disulfide.

7. The system of claim 1, wherein the controlled atmosphere has a humidity of at least 30 percent.

8. The system of claim 2 wherein the etching station comprises a container retaining an etching bath.

9. The system of claim 8 wherein the etching bath is hydrogen peroxide.

10. The system of claim 2 wherein the stripping station comprises an enclosure containing a solvent bath.

* * * * *